United States Patent [19]

Klebold

[11] Patent Number: 4,557,378

[45] Date of Patent: Dec. 10, 1985

[54] COMBINATION COLLAPSIBLE FUNNEL AND CANISTER THEREFOR

[76] Inventor: Franklin R. Klebold, P.O. Box 1721, Clovis, N. Mex. 88101

[21] Appl. No.: 554,398

[22] Filed: Nov. 22, 1983

[51] Int. Cl.[4] ..... B65D 69/00

[52] U.S. Cl. ..... 206/223; 206/216; 206/577; 220/8; 184/1.5; 141/98; 141/337

[58] Field of Search ..... 206/223, 577, 216, 303; 184/1.5; 141/337, 98; 220/8

[56] References Cited

U.S. PATENT DOCUMENTS 2,943,732 7/1960 Kovaleski et al. ..... 206/303
3,703,956 11/1972 Oswalt ..... 184/1.5
3,710,930 1/1973 Owdom ..... 206/216

FOREIGN PATENT DOCUMENTS 381262 11/1907 France ..... 141/337

*Primary Examiner*—Marion E. McCamish
*Assistant Examiner*—P. R. Schwartz
*Attorney, Agent, or Firm*—John F. Booth; Gerald G. Crutsinger; Monty L. Ross

[57] ABSTRACT

The invention relates to a combination collapsible funnel and canister therefor, comprising a sectional collapsible funnel, a canister adapted to receive the funnel, and means in the canister adapted to receive an adapter section of the funnel for storage.

8 Claims, 5 Drawing Figures

COMBINATION COLLAPSIBLE FUNNEL AND CANISTER THEREFOR

The present invention relates to a combination collapsible funnel and canister therefor and, more particularly, to a collapsible funnel with accompanying means for filling or fueling an instrument which requires fueling, oiling, or filling. The invention provides a collapsible filler funnel and canister therefor which, due to its compactness, can be readily stored in a condition of cleanliness and neatness.

The invention also relates to a collapsible funnel which is housed in a storage canister together with accompanying devices for the purpose of servicing internal combustion engines, certain camping equipment, outboard motors, portable lighting equipment, and the like. The collapsible funnel is of the telescoping type and extends to reach difficult-to-service areas, particularly in motor vehicles and the like, and also provides means for servicing a wide variety of devices, which means may all be stored in a single, sealed container.

An additional feature of the present invention is the provision of means whereby the lid of the canister may be used to double puncture the lid of a standard oil can, thus simultaneously providing both an opening for inflowing air and out-flowing fluid and, at the same time, adding to the compactness of the filling system.

Still another feature of the present invention is an adapter section which is adapted to fit on the bottom section of the collapsible filler funnel with a press fit. The adapter section has a two-fold purpose, i.e., of affording yet another filling stem a size smaller, and of accommodating an extension hose for reaching deeper filler ports. Ordinarily, an extension hose of approximately 10 inches in length is employed. Both the adapter section and the extension hose store within the canister along with the telescoping collapsible funnel.

Another feature of the present invention is the provision of a sponge or other absorbent material in the bottom of the canister to soak up any residual oil or other liquid which may drain off of the collapsed funnel when placed within the canister.

Collapsible funnels are known to the art.

U.S. Pat. No. 423,021 discloses a funnel consisting of multiple conical sections fitting one within another and connected and adjustable vertically by guide rods and eyes.

U.S. Pat. No. 954,161 discloses a funnel comprising a plurality of detachably engaged sections adapted to snugly fit each other when assembled to provide a rigid funnel and adapted to be nested one within the other when separated.

U.S. Pat. No. 1,007,401, discloses a collapsible straining funnel provided with a chamois diaphragm connected at its edge to the edge of the upper portion of the funnel and having its intermediate portion connected to a lower portion of the funnel, whereby when the funnel is extended the diaphragm will be drawn into the funnel.

U.S. Pat. No. 1,050,028 discloses a collapsible straining funnel comprising a hopper, a tapered portion in screw threaded engagement therewith, a discharge spout in screw threaded engagement with the tapered portion, the tapered portion and the spout being capable of being inverted and engaged with each other and the hopper, a strainer disposed within the hopper, and means for detachably securing the strainer in position.

U.S. Pat. No. 1,320,649, discloses a funnel of the type in which means are provided for automatically closing the spout of a funnel so as to prevent overflowing of a container being filled.

U.S. Pat. No. 1,660,442 discloses a folding and siphoning funnel having a valved hopper or receiving bowl with an extensible spout composed of telescoping sections adapted to be received one within the other and nested within the lower portion of the bowl.

U.S. Pat. No. 1,740,418 discloses a collapsible funnel and drinking cup having two series of telescoping conical sections, both secured to an intermediate member for service as a bottom for the drinking cup, and the collapsed article has a support for resting against the mouth of the vessel when the article is used as a funnel.

The present invention will be further illustrated by reference to the accompanying drawings in which.

Figure 1:
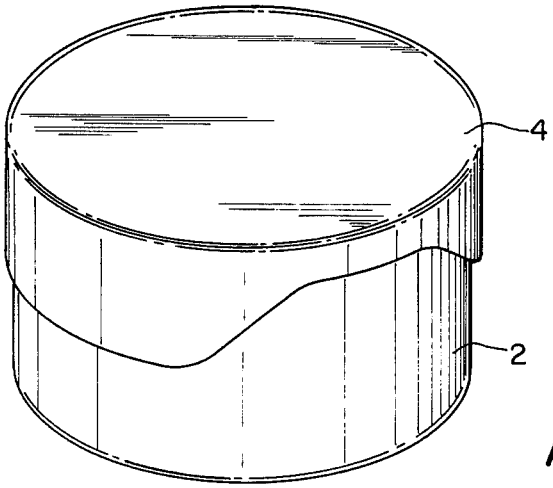
FIG. 1 is a perspective view of the canister of the present invention with the lid thereof in place thereon.

Referring to FIG. 1, the canister is composed of a cylindrical bowl 2 and a lid 4 therefor which is received on the bowl 2 by a press fit.

Figure 2:
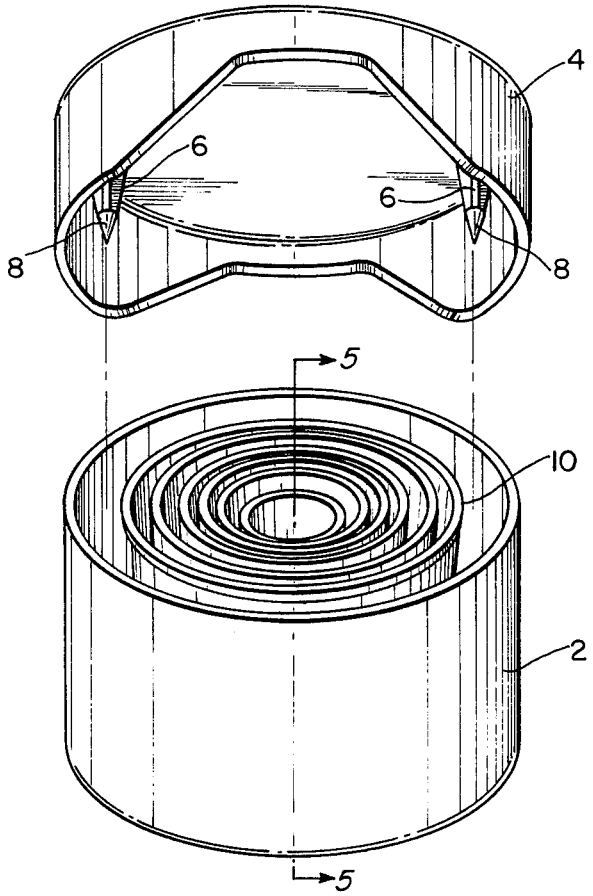
FIG. 2 is an exploded perspective view of the canister of the present invention showing the underside of the lid thereof and the collapsible funnel stored within the bottom portion of the canister.

In FIG. 2, the lid 4 is shown having two tines 6 on the underside thereof having pointed tips 9 on the ends thereof, which tips may be made of metal or similar material, whereas the canister bowl 2 and lid 4 may be made of plastic, metal, or other material as desired.

Within the bowl 2 is the collapsible funnel 10, the various sections of which are shown nested within the bowl 2.

Figure 4:
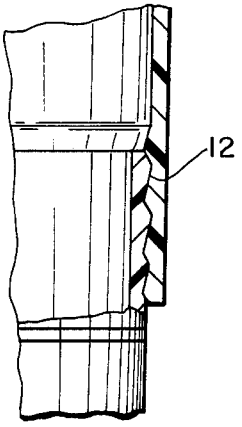
FIG. 4 is a sectional view taken on line 4—4 of FIG. 3.
Figure 3:
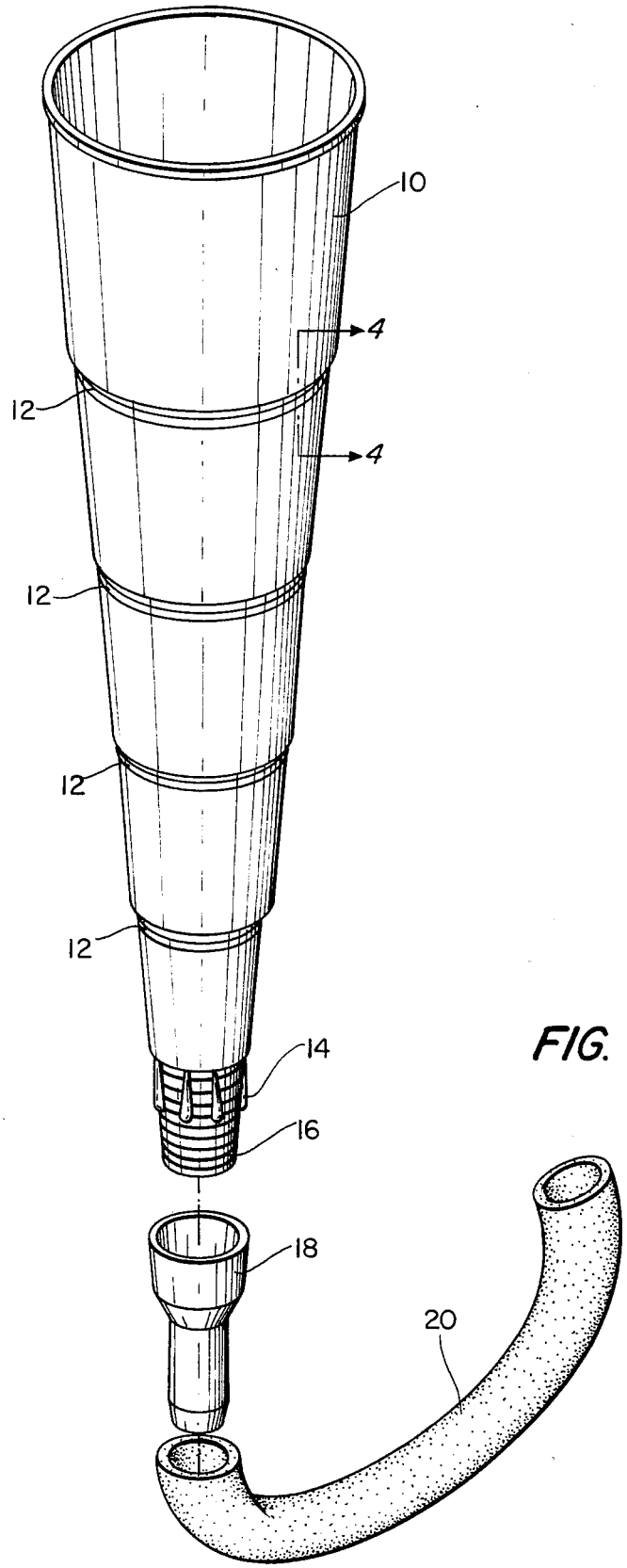
FIG. 3 is an exploded perspective view showing the collapsible funnel in the extended position, as it would be in use, and also showing an adapter section at the bottom of the funnel and an extension hose.

Referring to FIG. 3, the various sections of the collapsible funnel 10 are shown in an extended position with the tapering sections locking into each other by means of locator or locking rings 12 best shown in FIG. 4. Each section of the funnel, below the topmost section, has three rings at the top thereof. These locator or locking rings indicate when the funnel sections are properly seated. One ring should be visible in cold weather and two rings in hot weather. The lowermost section of the funnel shown in FIG. 3 has a number of raised portions 14 thereon which cause a frictional fit between the lowermost section of the funnel and the next upper section thereof. The lowermost section also has a number of rings 16 thereon which engage within the adapter section 18 and lock the latter onto the lowermost section of the funnel 10 when the adapter section 18 is in use.

A hose 20 also may be connected to the lower portion of the adapter section 18 in order to provide a filler extension hose for longer reach, such as when adding fluid to a transmission, for example.

Figure 5:
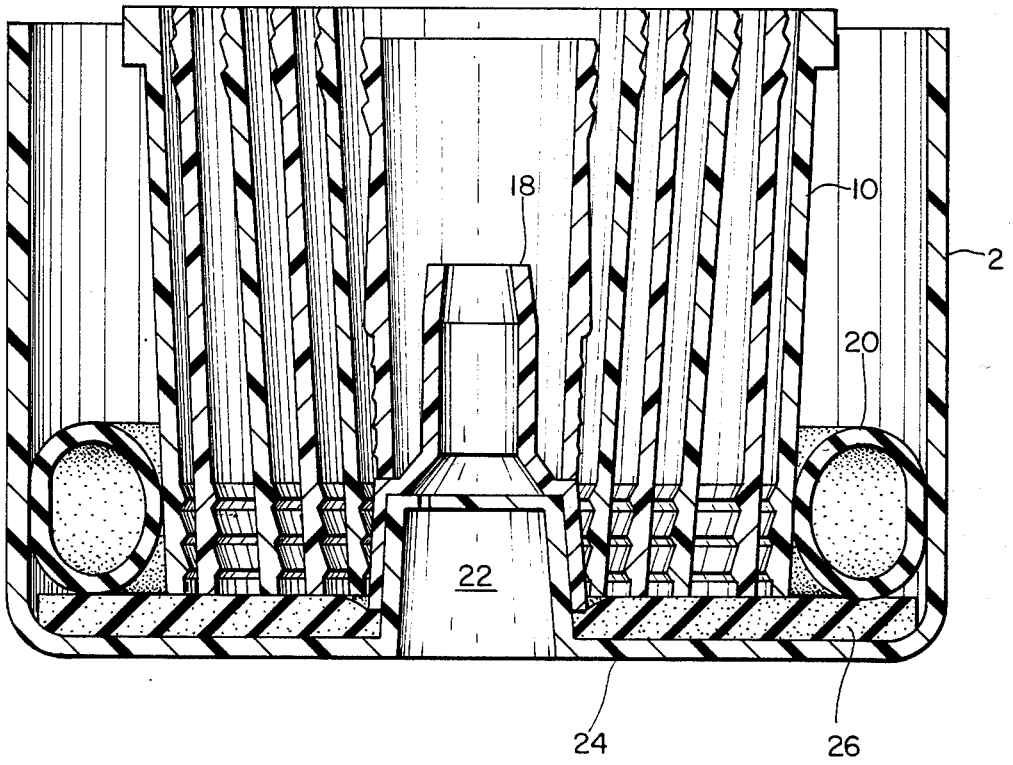
FIG. 5 is a sectional view taken on line 5—5 of FIG. 2 showing the collapsible funnel stored within the canister.

FIG. 5 is a sectional view showing the collapsible funnel stored in the bowl 2. The various sections of the funnel 10 are shown nested within the bowl 2, and the adapter section 18 is shown inverted and seated with a press fit on a stud 22 integrally molded into the base 24 of the bowl 2. The extension hose 20 is also shown seated within the bowl 2 on a sponge 26 which is used to soak up any oil or other material running off of the funnel 10, the adapter section 18, and the hose 20 after they have been placed in the bowl 2.

In using the funnel of the invention, the lid 4 may be peeled off the bowl 2 and the two tines 6, with the points 8 thereon, may be employed to open a standard oil can, if desired.

The funnel sections are then lifted up and out of the bowl 2 and the top and bottom of the funnel are grasped in either hand and pulled to fit the sections together.

Each joint between the funnel sections is then worked outwardly whereby the joints are seated. The locator ring or locking ring will appear just below each joint, which indicates that the joint is properly seated. As noted above, one ring should show in cold weather and two rings in hot weather. The funnel 10 is then ready for use.

The funnel 10 generally will consist of six sections, although more or less can be employed, and the lowermost section can be used as an emergency leaded to unleaded adapter.

When the adapter section 18 is to be used, it is pressed firmly onto the lowermost end of the funnel 10. The adapter section 18 generally will be used for filling transmissions, camping equipment, and the like. The extension hose 20 may be secured to the lower end of the adapter section 18 for a longer reach, and the extension hose 20 may be of any desired length, generally about 10 inches.

To store the funnel 10, the large end of the adapter section 18 is placed over the bowl stud 22, the extension hose 20 is curled to fit within the bowl 2, and pushed snugly to the bottom thereof.

The small end of the funnel 10 is guided over the inverted adapter section 18 and the top of the funnel 10 is pushed into the bowl 2, thereby collapsing the funnel 10 within the bowl 2 in a nested position. The lid 4 then may be placed thereon.

As noted above, the sponge 24 will soak up any fluid running off of the various elements of the funnel assembly and this sponge 24 can be removed for clean-up as desired.

The entire funnel, canister, hose, adapter section, and sponge preferably are made of a suitable plastic. The can-opening tips, as noted above, preferably are of metal.

It will be obvious to those skilled in the art that many modifications may be made within the scope of the present invention without departing from the spirit thereof, and the invention includes all such modifications.

What I claim is:

1. A combination collapsible funnel and canister therefor comprising a collapsible funnel means including a plurality of frusto-conical shaped funnel sections of various sizes which allow the sections to telescope and fit inside each other when collapsed and interfit when extended, a plurality of protrusions and indentations at the edges of said sections for engaging corresponding protrusions and indentations on adjacent sections when extended to form an interlocking interference fit seal between adjacent sections whereby inadvertent collapse of said funnel and leaking between said sections is prevented and canister means adapted to receive said funnel means when collapsed and having a protruding stud fixed to the base thereof internally said stud being of a size to fit into the smaller end of the smallest of said funnel sections.

2. A collapsible funnel and canister therefor according to claim 1 including an adapter section of a size and shape for its larger end to connect to the smaller end of the smallest of said funnel sections and an extension hose means of a size to be connected in fluid communication with the smaller end of said adapter section.

3. A collapsible funnel and canister according to claim 1 wherein the interior depth of said canister is approximately equal to the axial length of the largest of said funnel sections.

4. A collapsible funnel and canister according to claim 2 wherein said stud in said canister is of a size and shape to be received within the larger end of said adapter in a press fit thereby to hold said adapter in an inverted upright position within said container unconnected to said funnel sections when said adapter is mounted on said stud.

5. A collapsible funnel and canister according to claim 4 being so arranged and constructed that when said adapter is mounted on said stud and said funnel is collapsed and received in said canister, the small end of the smallest of said funnel sections rests on the larger end of said adapter with the smaller end of said adapter extending into said smallest section.

6. A collapsible funnel and canister according to claim 5 further including lid means for closing the open end of said canister and means on said lid means for opening a can.

7. A collapsible funnel and canister according to claim 6 wherein said canister is of such size and internal capacity with its open end closed by said lid means as to accommodate the collapsed funnel sections, the adapter mounted on said stud and the extension hose therein.

8. A combination collapsible funnel and canister therefor comprising a telescopically collapsing funnel means, an adapter section, an extension hose, a canister open at one end and a canister lid including can opening means thereon, said lid adapted to close said one end of said canister, said funnel means comprising a plurality of frusto-conical shaped funnel sections of various sizes which allow the sections to fit inside each other when said funnel means is telescopically collapsed and to interfit with each other when said funnel means is extended, said sections having a plurality of protrusions and indentations at their edges adapted to engage corresponding protrusions and indentations on adjacent sections when said funnel means is extended to form an interlocking interference fit seal between adjacent sections whereby inadvertent collapse of and leaking between said sections of said funnel means is prevented, said canister having a protruding stud fixed to the base thereof internally, said stud being of such size as to fit through the smaller end of the smallest of said funnel sections, said adapter section having a smaller end of such size and shape as to be connected in fluid communication with said extension hose and a larger end of such size and shape as to be connected in fluid communication with the smaller end of the smallest of said funnel sections and alternately to be placed in said container mounted on said stud with said stud extending into said larger end in press fit, whereby said adapter is held in an inverted upright position within said canister unconnected to said extension hose and said funnel sections and the smaller end of the smallest of said funnel sections rests on said larger end of said adapter with the smaller end of said adapter extending into said smallest section when said funnel means is collapsed and received into said canister, said canister being of such size and internal capacity as to accommodate therewithin said funnel sections, said adapter section mounted on said stud and said extension hose when closed by said canister lid.

* * * * *